United States Patent [19]

Synowicki

[11] 4,364,155

[45] Dec. 21, 1982

[54] JEWELRY CLASP

[76] Inventor: Walter Synowicki, 2016 W. Lodi Ave., Lodi, Calif. 95240

[21] Appl. No.: 203,272

[22] Filed: Nov. 3, 1980

[51] Int. Cl.[3] ..... A44B 19/00

[52] U.S. Cl. ..... 24/217 R; 24/221 R

[58] Field of Search ..... 24/211 L, 211 M, 211 P, 24/217 R, 219, 220, 221 R

[56] References Cited

U.S. PATENT DOCUMENTS

| | | | |
|---|---|---|---|
| 147,965 | 2/1874 | Opdyke . | |
| 805,674 | 11/1905 | Senderling . | |
| 845,654 | 2/1907 | Layng . | |
| 869,059 | 10/1907 | Cashmore . | |
| 913,854 | 3/1909 | Seidl . | |
| 1,199,690 | 9/1916 | Gillan | 24/221 R |
| 2,674,774 | 4/1954 | Modrey | 24/211 |
| 2,981,995 | 5/1961 | Golubics | 24/221 |
| 3,145,441 | 8/1964 | Strandrud | 24/211 |
| 3,487,512 | 1/1970 | Marosy | 24/221 R |
| 3,540,087 | 11/1970 | Marosy | 24/221 R X |
| 3,611,513 | 10/1971 | Hoober et al. | 24/211 |
| 4,308,646 | 1/1982 | Schenk | 24/221 R |

*Primary Examiner*—Robert P. Swiatek
*Attorney, Agent, or Firm*—Roger B. Webster

[57] ABSTRACT

A quick-engageable, quick-disengageable coupling or clasp for connecting the ends of a piece of jewelry such as a necklace or bracelet. The clasp includes two initially separate longitudinal bodies end-alined in use, one body having a lengthwise projecting, inner end tongue, and the other body having an inner end slot and adapted for reception, by longitudinal insertion through the slot, of the tongue; the clasp being particularly characterized by the inclusion of instrumentalities operative, without more, to secure the tonque in the other body and thus quick-engage the clasp upon the tongue being so inserted, and to release the tongue upon relative rotation of the bodies and thus quick-disengage the clasp.

10 Claims, 17 Drawing Figures

FIG-1
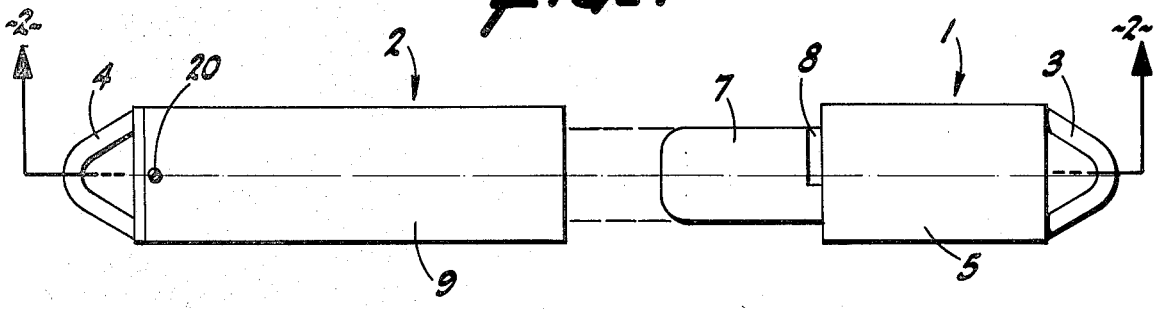
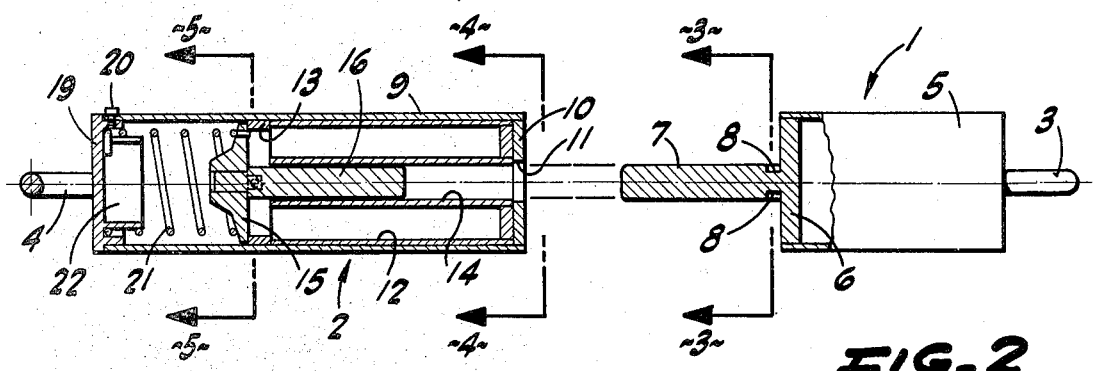
FIG-2
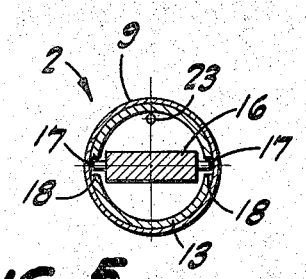
FIG-5
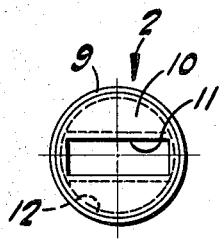
FIG-4
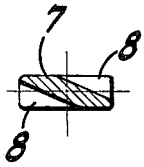
FIG-3
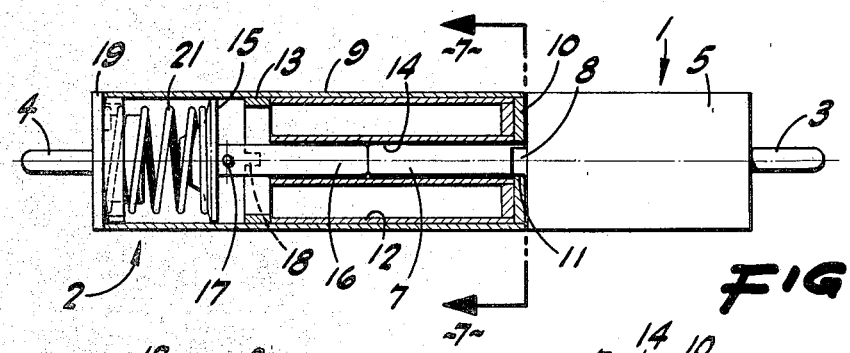
FIG-6
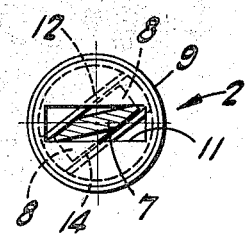
FIG-8
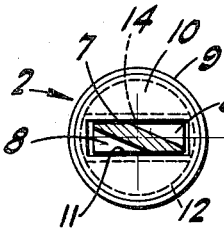
FIG-7

4
19
22
21
17
16
23
15
18
13
18
12
14
20
9
10
11
7
1
5
3

FIG-10
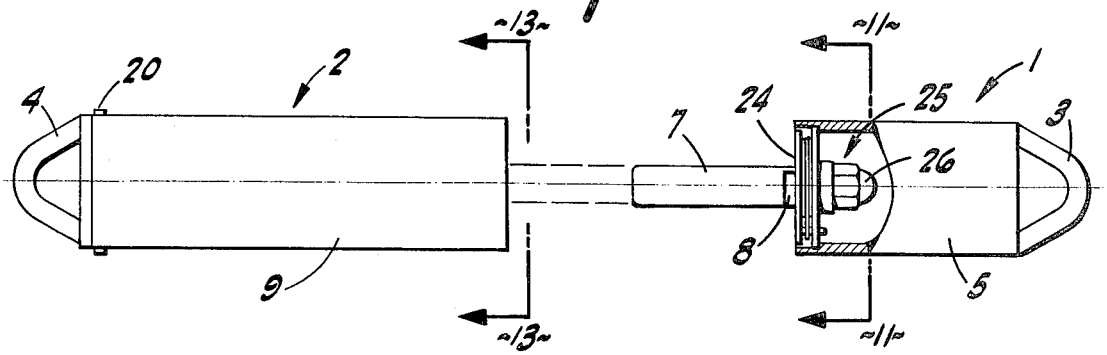
FIG-12
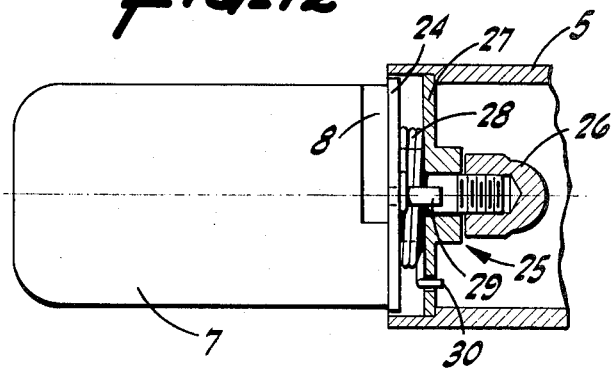
FIG-11
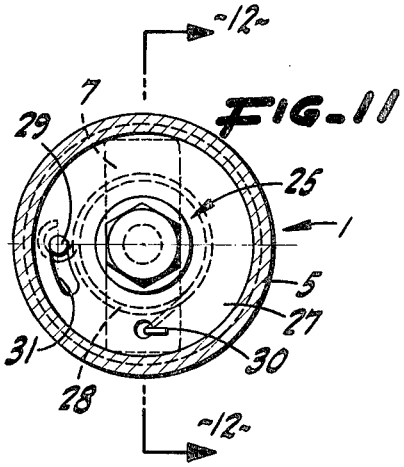
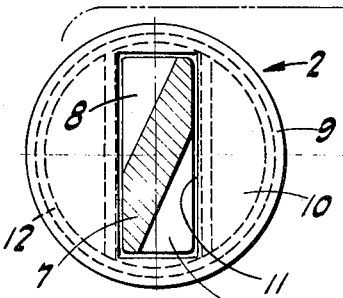
FIG-15
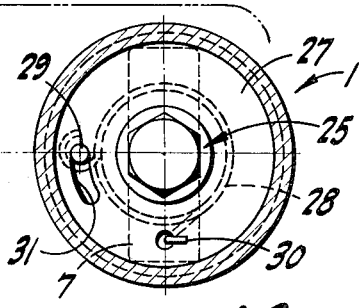
FIG-14
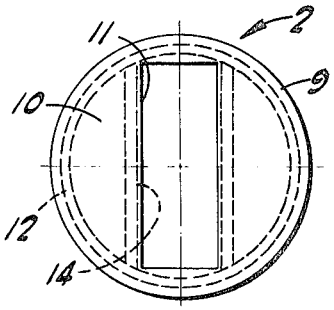
FIG-13
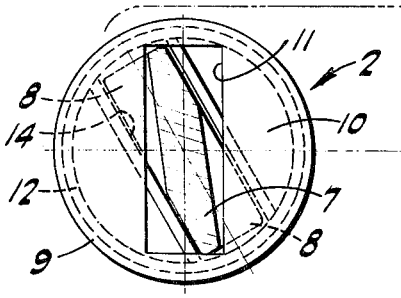
FIG-17
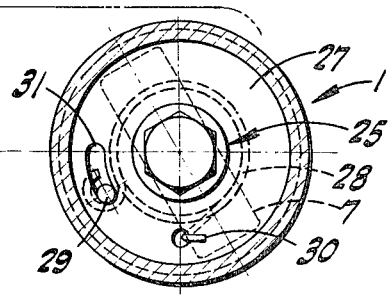
FIG-16

JEWELRY CLASP

BACKGROUND OF THE INVENTION

1. Field of the Invention

Jewelry clasps are known wherein longitudinal, end-alined bodies are connected by a tongue projecting from one body into the other body and releasably engaged, as by friction, therein. In such known jewelry clasps, difficulty is often encountered in maintaining the tongue against accidental release and escape with consequent disengagement of the clasp and possible resultant loss of the jewelry. Additionally, in some instances, the clasp structure—obviously necessarily small—was difficult to assemble, may not have been sufficiently sturdy and hence subject to wear and tear, or could not be readily manipulated for engaging or disengaging the clasp. The present invention was conceived in a successful effort to provide a jewelry clasp which avoids such undesirable factors.

2. The Prior Art

Applicant is not aware of any issued United States patent, or other prior art, disclosing the particular structure and function of the jewelry clasp shown and claimed herein; U.S. Pat. No. 147,965 being representative of the prior art known to applicant.

SUMMARY OF THE INVENTION

The present invention is directed to, and it is a major object to provide, a novel quick-engageable, quick-disengageable coupling or clasp for connecting the ends of a piece of jewelry such as a necklace or bracelet.

The present invention provides, as another important object, a jewelry clasp, as in the preceding paragraph, wherein the clasp includes two initially separate longitudinal bodies end-alined in use, one body having a lengthwise projecting inner end tongue, and the other body having an inner end slot and adapted for reception, by longitudinal insertion through the slot, of the tongue; the clasp being particularly characterized by the inclusion of instrumentalities operative, without more, to secure the tongue in said other body and thus quick-engage the clasp upon the tongue being so inserted, and to release the tongue upon relative rotation of the bodies and thus quick-disengage the clasp.

The present invention provides, as an additional object, a clasp which, while especially adapted for use with jewelry, is readily adaptable—with size variation—for other coupling uses.

The present invention provides, as a still further object, a practical, reliable, and durable jewelry clasp, and one which is easy to manufacture, including assembly, and exceedingly effective for the purpose for which it is designed.

BRIEF DESCRIPTION OF THE DRAWINGS

FIG. 1 is an enlarged elevation of the clasp with the male and female units disengaged and separated.

FIG. 2 is a similar view, but with the clasp rotated 45 degrees about its axis; the male unit being partly in section, and the female unit in full section. The view is taken substantially on line 2—2 of FIG. 1.

FIG. 3 is a cross section taken substantially on line 3—3 of FIG. 2.

FIG. 4 is a cross section taken substantially on line 4—4 of FIG. 2.

FIG. 5 is a cross section taken substantially on line 5—5 of FIG. 2.

FIG. 6 is a view similar to FIG. 2, but shows the male and female units as initially engaged.

FIG. 7 is a cross section taken substantially on line 7—7 of FIG. 6; the view showing the position of the tongue of the male unit just before rotation to latching position.

FIG. 8 is a similar view, but shows the position of the tongue of the male unit after rotation to latching position.

FIG. 10 is an elevation of the clasp with the male and female units disengaged and separated; the male unit being of modified form and shown partially broken away and in section.

FIG. 11 is an enlarged cross section taken substantially on line 11—11 of FIG. 10.

FIG. 12 is a fragmentary elevation, partly in section, taken substantially on line 12—12 of FIG. 11.

FIG. 13 is an enlarged cross section taken substantially on line 13—13 of FIG. 10.

FIG. 14 duplicates FIG. 11, but here is shown bracketed with FIG. 15.

FIG. 15 is an enlarged cross section showing the position of the tongue of the male unit just before rotation to latching position; FIG. 15 being bracketed with FIG. 14 to illustrate the then relative positions of the parts of the rotary mount for the tongue of the male unit.

FIG. 16 is a view similar to FIGS. 11 and 14, but, shown bracketed with FIG. 17, illustrates the relative positions of the parts of the rotary mount for the tongue of the male unit after rotation of said tongue to latching position.

FIG. 17 is a view similar to FIG. 15, but, shown bracketed with FIG. 16, illustrates the position of the tongue of the male unit as so rotated to latching position.

DESCRIPTION OF THE PREFERRED EMBODIMENT

Figure 9:
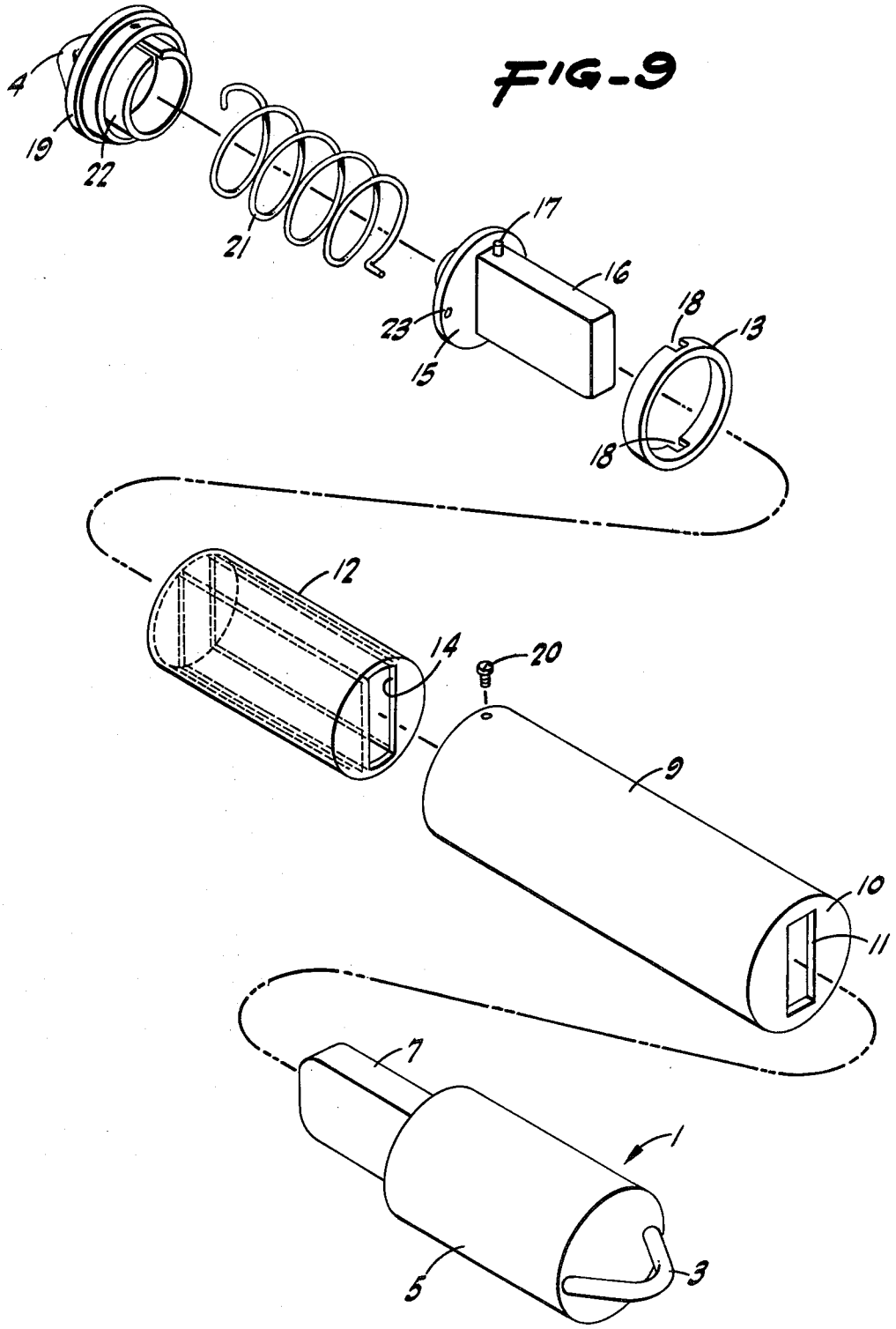
FIG. 9 is an exploded view showing the several parts of the clasp.

Referring now more particularly to the drawings, and to the characters of reference marked thereon, and at present to the embodiment of FIGS. 1-9, inclusive, the jewelry clasp of the present invention comprises—preferably in cylindrical form and in initially separated relation—a male unit, indicated generally at 1, and a female unit, indicated generally at 2, adapted to be disposed in end-to-end longitudinal alinement. The male unit 1 includes an attachment eye 3 at its outer end, and the female unit 2 includes an attachment eye 4 at its outer end.

The male unit 1 embodies a cylindrical body 5 fitted with an inner end wall 6 from which a fixed, longitudinal tongue 7 projects; the tongue 7, while rectangular in cross section, being flat; i.e., of substantial width in one dimension, but relatively narrow in the other dimension.

Immediately outwardly of the inner end wall 6, the tongue 7 is formed, on opposite sides, with opposed, parallel notches 8 which open laterally and extend diagonally transversely of, and relative to, the major longitudinal plane of said tongue.

The female unit 2 embodies a cylindrical body 9 fitted with an inner end wall 10; such wall 10 being formed with a diametral or symmetrically disposed rectangular opening or slot 11 dimensioned for the matching but sliding reception therethrough of the tongue 7 of male unit 1.

An elongated, turnable sleeve 12 is disposed in close fitting relation in the cylindrical body 9, and such sleeve extends between the end wall 10 and a radially thin ring 13 fixed in said body 9 intermediate the ends thereof.

Within the confines thereof, but open to both of its ends, the turnable sleeve is formed with a four-sided, longitudinal, tongue-receiving passageway 14 which is formed—in rectangular cross section—so that at the end adjacent wall 10 such passageway initially matchingly registers with the slot 11. The passageway 14 is thus adapted to receive the tongue 7 in matching, sliding relation upon insertion of said tongue 7 through the slot 11 in end wall 10.

A disc 15 is disposed in close fitting relation in the body 9, and initially abuts the fixed ring 13 on the side opposite the sleeve 12; the disc 15 being formed with a fixed, longitudinal tongue 16 which projects through the ring 13 and thence into the passageway 14. The tongue 16 is of substantially the same cross section as tongue 7 and initially fully engages in passageway 14 in matching but sliding relation. The combined length of tongues 7 and 16 is substantially greater than the length of passageway 14 plus the axial extent of ring 13.

Immediately adjacent the disc 15, the tongue 16 is provided, on each of its opposite edges, with an outwardly projecting pin 17 which extends radially of the ring 13 and initially seats in a corresponding pin-receiving notch 18 in said ring 13. Such pin and notch arrangement provides, in effect, a clutch which is initially engaged.

The body 9, of the female unit 2, is closed at its outer end by an end head 19 suitably secured in place; the securing means being here shown, for illustration, as screws 20. As shown, the end head 19 is fitted with the eye 4.

A helical spring 21 is disposed in body 9 and extends, in connection, between the head 19 and the disc 15; one end of the spring hook-engaging a neck 22 of head 19, while the other end of the spring tip-engages in a receiving hole 23 in the disc 15.

The helical spring is always under some loading both as to compression and torque, and thus—while the torque effect tends to rotate disc 15 in one direction—the compression effect (i.e., tendency to expand) maintains the pins 17 in notches 18 so that the disc is releasably held against rotative motion.

In use of the above-described jewelry clasp, it is manipulated and functions as follows:

With the hands of the wearer finger-grasping the units 1 and 2 of the clasp, the tongue 7 is projected through slot 11 in wall 10, and the bodies 5 and 9 are moved axially together until the tongue is inserted to full extent in the passageway 14, and at which time the bodies 5 and 9 are in end abutment.

Upon the tongue 7 being thus thrust into the passageway 14, tongue 7 end-abuts tongue 16 and shifts the latter in a direction to move the disc 15 a distance, in the direction of head 19, sufficient to withdraw the pins 17 from notches 18 and thus un-clutch such disc, and which, at the same time, further loads and hence increases the compression effect of the spring 21.

Upon the disc 15 being thus un-clutched, the spring 21—through the medium of its torque effect—simultaneously rotates the disc 15 and consequently the tongue 16, sleeve 12, and tongue 7; the latter, including all of body 5, turning until adjacent portions of end wall 10 quick-engage in the laterally opening notches 8 to provide not only a stop for the turning motion, but latching the tongue against accidental withdrawal and escape from the passageway 14. Such latching of the clasp is yieldably maintained by the torque effect of the spring 21, and until it is desired to disengage the clasp.

Quick-disengagement of the clasp is accomplished as follows:

With the hands of the wearer finger-grasping the units 1 and 2 of the clasp, the bodies 5 and 9 are relatively rotated about the axis thereof, against the torque of spring 21, and in a direction such that the tongue 7 is manually counter-rotated until the engaged portions of the end wall 10 escape the notches 8, whereupon—under the compression effect of spring 21—the disc 15 and tongue 16 are thrust axially in a direction to re-seat pins 17 in notches 18 and simultaneously shift tongue 7 out of the passageway a distance sufficient to dispose the notches 8 outwardly of end wall 10, whereupon the clasp can be disengaged by manual completion of withdrawal of tongue 7 from the female unit 2.

When the clasp is quick-engaged in the manner previously described, the body 5 of the male unit 1 part-turns in the wearer's hand when the rigidly connected tongue 7 is spring-rotated to latching position. If it is desired to prevent such part-turning, the male unit 1 may be modified by the inclusion of a rotary mount for the tongue and in the manner disclosed in FIGS. 10–17, inclusive, of the drawings, and wherein unmodified parts—corresponding to FIGS. 1–9, inclusive—bear like reference numerals.

In the modified male unit 1 of FIGS. 10–17, the body 5 is provided at its inner end with an inset, turnable, circular plate 24; the tongue 7 being fixedly secured at its adjacent end to, and projects from, such plate in symmetrical relation thereto. The plate 24 is turnably supported by an axial spindle assembly 25 retained by a nut 26 and journaled in connection with a fixed radial wall 27 mounted in body 5 in adjacent but inwardly spaced relation to the turnable plate 24.

A coil spring 28 is disposed between turnable plate 24 and fixed wall 27 and surrounds the adjacent portion of the spindle assembly 25; such spring being anchored at one end to a stud 29 on the back face of turnable plate 24, and at the other end is anchored to fixed wall 27 as at 30. The stud 29—which extends parallel to the axis of the spindle assembly 25—extends into a short, arcuate, concentric slot 31 in the fixed wall 27; the loading of the spring being such that the stud 29 is normally maintained in one end of slot 31 and with the tongue 7 in a rotary position normal to the body 5 as shown, for example, in FIGS. 10, 11, and 14.

Upon the engagement of the clasp as previously described and when the tongue 7 of the male unit 1 is thrust into the body 9 of the female unit 2, such tongue 7 part-turns as the clasp latches, but the body 5 does not respond to such turning motion by reason of the limited rotation permitted by the spindle assembly 25. When such limited rotation of the tongue 7 occurs, the plate 24, of course, part-turns, and this moves the stud 29 from one end of the slot 31 (see FIGS. 11 and 14) to the other end of such slot (see FIG. 16), and which is in a direction to further load the spring 28. Thereafter, upon subsequent disengagement of the clasp by withdrawal of the tongue 7 from the female unit 2, the spring 28 counter-rotates the plate 24, returns the stud 29 to the starting end of slot 31, and also returns the tongue to its normal position.

Thus, with the above-described rotary mount for the tongue 7, the body 5 of the male unit 1 does not—in the embodiment of FIGS. 10–17, inclusive—part-turn in the wearer's hand when the clasp is engaged and latched.

From the foregoing description, it will be readily seen that there has been produced such a jewelry clasp as substantially fulfills the objects of the invention, as set forth herein.

While this specification sets forth in detail the present and preferred construction of the jewelry clasp, still in practice such deviations from such detail may be resorted to as do not from a departure from the spirit of the invention as defined by the appended claims.

I claim:

1. A clasp comprising a male unit having a longitudinal body, a female unit having a longitudinal body, the bodies being adapted to be disposed end-to-end, a tongue secured to and projecting from the inner end of the male body, the female body including an inner end wall having a slot configured and adapted for the projection therethrough, in close-fitting but slidable relation, of the tongue when the latter is inserted into the female body upon relative longitudinal movement of the bodies into substantially end abutment, the inner-end portion of the tongue being formed on opposite sides with laterally opening notches, the notches alining with the inner end wall of the female body when the tongue is inserted thereinto, and mechanism in the female body operative, in response to said insertion of the tongue, to impart limited rotation to the tongue in a direction to seat the adjacent portions of the said inner end wall in the notches whereby to latch the clasp; said mechanism including a helical spring which functions by torque to urge the tongue toward and yieldably maintain the tongue in said limited rotative position with the clasp engaged; and the clasp bei corresponding relative nter-rotation of the tongue against said torque byrotation of the male body whereupon said portions of said inner end wall escape the notches to permit withdrawal of the tongue from the female body.

2. A clasp comprising a male unit having a longitudinal body, a female unit having a longitudinal body, the bodies being adapted to be disposed end-to-end, a tongue secured to and projecting from the inner end of the male body, the female body including an inner end wall having a slot configured and adapted for the projection therethrough, in close-fitting but slidable relation, of the tongue when the latter is inserted into the female body upon relative longitudinal movement of the bodies into substantially end abutment, the inner-end portion of the tongue being formed on opposite sides with laterally opening notches, the notches alining with the inner end wall of the female body when the tongue is inserted thereinto, and mechanism in the female body operative, in response to said insertion of the tongue, to impart limited rotation to the tongue in a direction to seat the adjacent portions of the said inner end wall in the notches whereby to latch the clasp, said mechanism including a helical spring which functions by torque to urge the tongue toward and yieldably maintain the tongue in said limited rotative position with the clasp engaged, there being a rotative member in the female body adapted to receive the tongue when so inserted, the spring being associated with the member in a manner to function by torque to rotate said member in a direction to impart said limited rotation of the tongue, an initially engaged clutch arranged with said member operative to prevent said rotation thereof by the spring, and means associated with the member operative to disengage the clutch in response to said insertion of the tongue; the clasp being disengageable upon counter-rotation of the tongue against said torque by corresponding relative rotation of the male body whereupon said portions of said inner end wall escape the notches to permit withdrawal of the tongue from the female body.

3. A clasp comprising a male unit having a longitudinal body, a female unit having a longitudinal body, the bodies being adapted to be disposed end-to-end, a tongue secured to and projecting from the inner end of the male body, the female body including an inner end wall having a slot configured and adapted for the projection therethrough, in close-fitting but slidable relation, of the tongue when the latter is inserted into the female body upon relative longitudinal movement of the bodies into substantially end abutment, the inner-end portion of the tongue being formed on opposite sides with laterally opening notches, the notches alining with the inner end wall of the female body when the tongue is inserted thereinto, and mechanism in the female body operative, in response to said insertion of the tongue, to impart limited rotation to the tongue in a direction to seat the adjacent portions of the said inner end wall in the notches whereby to latch the clasp; said mechanism including a longitudinal, rotatable sleeve in the female body, a longitudinal passageway formed in the sleeve and at one end initially in register with the slot in said inner end wall, the tongue when so inserted being received in said passageway for rotation with the sleeve, a helical spring disposed in the female body between its outer end and the sleeve, a rotary disc in the sleeve between the inner end of the spring and the sleeve, the spring being attached at its respective ends to the outer end of the female body and said disc, connection means between the disc and the sleeve, the spring being under torque and tending to rotate the disc and sleeve in a direction to impart said limited rotation to the inserted tongue, and an engaged clutch associated with the connection means operative to initially prevent such rotation of the disc, and said connection means being arranged so that the clutch is disengaged upon and in response to said insertion of the tongue.

4. A clasp, as in claim 3, in which the connection means includes another tongue, said other tongue being fixed on the disc and projecting into the passageway, from its adjacent end, for turning with the sleeve, and the clutch being disengageable upon shifting of said other tongue in the direction of the spring; said other tongue being end-engaged and so shifted by, and upon said insertion of, the tongue of the male body.

5. A clasp, as in claim 4, including a ring fixed in the female body intermediate the sleeve and the disc; said other tongue extending through the ring, and the clutch including a pin projecting from said other tongue in a direction radially of the ring, and the latter having a notch in which the pin initially engages; the ring notch opening in a direction such that the pin escapes therefrom upon said shifting of said other tongue.

6. A clasp comprising a male unit having a longitudinal body, a female unit having a longitudinal body, the bodies being adapted to be disposed end-to-end, a tongue secured to and projecting from the inner end of the male body, the female body including an inner end wall having a slot configured and adapted for the projection therethrough, in close-fitting but slidable relation, of the tongue when the latter is inserted into the female body upon relative longitudinal movement of the bodies into substantially end abutment, the inner-end portion of the tongue being formed on opposite sides with laterally opening notches, the notches alining with the inner end wall of the female body when the tongue is inserted thereinto, and mechanism in the female body operative, in response to said insertion of the tongue, to impart limited rotation to the tongue in a direction to seat the adjacent portions of the said inner end wall in the notches whereby to latch the clasp; the clasp including means securing the tongue on the male body for limited rotation, about the longitudinal axis thereof, from an initial position occupied by said tongue prior to said insertion thereof.

7. A clasp, as in claim 6, including spring means connected between the tongue and male body yieldably rotatively urging the tongue in the direction of said initial position thereof.

8. A clasp, as in claim 6, in which said securing means includes a turnable circular plate at the inner end of the male body, the tongue being fixed on and projecting from said turnable plate, a fixed wall in the male body adjacent but spaced from the turnable plate, a spindle assembly journaling the turnable plate in connection with the fixed wall, the latter having an arcuate slot therein concentric to the axis of the spindle assembly, a stud projecting from the turnable plate into the arcuate slot whereby to limit rotation of the turnable plate and tongue, and a coil spring disposed between the turnable plate and fixed wall in surrounding relation to the axis of the spindle assembly; the coil spring being connected, under load, at its respective ends to said turnable plate and fixed wall whereby to yieldably rotate the turnable plate to dispose the tongue—when not so inserted—in said initial position and with the stud then retracted in the arcuate slot to a corresponding end thereof.

9. A clasp comprising a male unit having a longitudinal body, a female unit having a longitudinal body, the bodies being adapted to be disposed end-to-end, a tongue secured to and projecting from the inner end of the male body, the female body including an inner end wall having a slot configured and adapted for the projection therethrough, in close-fitting but slidable relation, of the tongue when the latter is inserted into the female body upon relative longitudinal movement of the bodies into substantially end abutment, the inner-end portion of the tongue being formed on opposite sides with laterally opening notches, the notches alining with the inner end wall of the female body when the tongue is inserted thereinto, and mechanism in the female body operative, in response to said insertion of the tongue, to impart limited rotation to the tongue in a direction to seat the adjacent portions of the said inner end wall in the notches whereby to latch the clasp; said mechanism including, within the confines of the female body, spring means operative by torque to impart said limited rotation to the tongue when so inserted.

10. A clasp, as in claim 9, in which said spring means is operative, by expansion, to impose thrust on the tongue to initiate said withdrawal of the tongue after escape of said inner end wall portions from the notches.

* * * * *